US006883343B2

(12) United States Patent
Lane et al.

(10) Patent No.: US 6,883,343 B2
(45) Date of Patent: Apr. 26, 2005

(54) SERVICE CASE

(75) Inventors: Mark Lane, Acworth, GA (US); Michael B. Davidson, Mississauga (CA)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/465,367

(22) Filed: Jun. 18, 2003

(65) Prior Publication Data

US 2003/0205053 A1 Nov. 6, 2003

Related U.S. Application Data

(62) Division of application No. 10/223,760, filed on Aug. 19, 2002, now abandoned.

(60) Provisional application No. 60/314,196, filed on Aug. 22, 2001.

(51) Int. Cl.[7] ..... A47F 3/04

(52) U.S. Cl. ..... 62/246; 62/257; 62/434

(58) Field of Search ..... 62/246, 255, 251, 62/257, 234, 235

(56) References Cited

U.S. PATENT DOCUMENTS

| | | | | |
|---|---|---|---|---|
| 1,594,653 A | | 8/1926 | Anstey | |
| 1,691,706 A | | 11/1928 | Daemicke | |
| 1,721,145 A | | 7/1929 | Bromann | |
| 1,863,427 A | | 6/1932 | Warren | |
| 1,896,693 A | | 2/1933 | Battista | |
| 2,136,232 A | * | 11/1938 | Browmann, Jr. | 62/89 |
| 2,181,635 A | | 11/1939 | Tull | 62/89.5 |
| 2,181,636 A | | 11/1939 | Saunders | 62/89.5 |
| 2,181,637 A | | 11/1939 | Ardito | 62/89.5 |
| 2,209,690 A | | 7/1940 | Fraser | 62/89.6 |
| 2,214,239 A | | 9/1940 | Young | 62/89.5 |

(Continued)

FOREIGN PATENT DOCUMENTS

| | | | | |
|---|---|---|---|---|
| DE | 25 05 390 A1 | | 8/1976 | A47F/3/04 |
| EP | 0 701 097 B1 | | 5/1998 | F25D/25/02 |
| GB | 2 185 561 A | | 7/1987 | A47F/3/04 |
| JP | 409229527 A | * | 9/1997 | |
| JP | 02000274935 A | * | 10/2000 | |
| JP | 2000-274935 A | | 10/2000 | F25D/25/02 |

*Primary Examiner*—William Doerrler
*Assistant Examiner*—Mohammad M. Ali
(74) *Attorney, Agent, or Firm*—Foley & Lardner LLP

(57) ABSTRACT

A temperature controlled service case for storage and display of chilled or frozen products, including at least one compartment for product storage, at least one access opening providing entrance to the compartment, at least one shelf within the compartment for holding product, and refrigeration operatively associated with the compartment for maintaining a selected temperature therein. The refrigeration includes at least one cooling coil above the shelf with a cooling medium flowing therethrough, and cooling within the shelf with a cooling medium flowing therethrough. Coolant supply is also provided for supplying cooling medium to the cooling coil and shelf with separate coolant supply and discharge lines from the coolant supply to the cooling coil and shelf. In accordance with a further embodiment, the shelf is divided into separate sections. In accordance with a still further embodiment, means are provided to warm the coolant for at least one of said cooling coil and shelf.

22 Claims, 6 Drawing Sheets

U.S. PATENT DOCUMENTS 2,225,655 A 12/1940 Ottenheimer ..... 40/130
2,279,484 A 4/1942 Munshower ..... 62/89.5
2,326,189 A 8/1943 Brace et al. ..... 62/99
2,379,885 A 7/1945 Davis ..... 62/89.5
2,382,599 A 8/1945 Blair ..... 62/89.5
2,425,473 A 8/1947 Hoffman ..... 62/89.5
2,444,593 A 7/1948 Davis ..... 62/6
2,477,393 A 7/1949 Skoog et al. ..... 62/89.5
2,495,327 A 1/1950 Hardin ..... 62/89.6
2,513,675 A 7/1950 Quillen ..... 62/89.5
2,607,204 A 8/1952 Kleist ..... 62/116
2,660,864 A 12/1953 Morris ..... 62/89.5
2,663,159 A 12/1953 Ullstrand ..... 62/95
2,690,650 A 10/1954 Pichler ..... 62/89.5
2,732,689 A 1/1956 Shreve ..... 62/89.5
2,932,955 A 4/1960 Hargrave et al. ..... 62/255
2,962,874 A 12/1960 Fitzgerald ..... 62/251
2,973,631 A 3/1961 Adkins ..... 62/246
3,056,274 A 10/1962 Pouchert ..... 62/418
3,230,732 A 1/1966 Rutishauser et al. ..... 62/255
3,254,502 A 6/1966 Ellis ..... 62/257
3,561,230 A 2/1971 Gatton et al. ..... 62/256
3,590,802 A * 7/1971 Fried ..... 126/19.5
3,677,025 A 7/1972 Payne ..... 62/81
3,730,603 A 5/1973 Looms ..... 312/116
3,848,426 A * 11/1974 Whitney ..... 62/255
3,850,486 A 11/1974 Saxe ..... 312/116
3,898,864 A * 8/1975 Steelman ..... 62/272
3,937,033 A 2/1976 Beckwith et al. ..... 62/155
3,978,684 A 9/1976 Taylor ..... 62/324
4,135,369 A * 1/1979 Allgeyer et al. ..... 62/251
4,265,092 A 5/1981 Abraham ..... 62/155
4,361,012 A 11/1982 Ibrahim ..... 62/82
4,369,631 A 1/1983 Abraham ..... 62/82
4,369,632 A 1/1983 Abraham ..... 62/82
4,370,867 A 2/1983 Ibrahim ..... 62/256
4,375,155 A 3/1983 Rosanio et al. ..... 62/256
4,404,816 A 9/1983 Ibrahim et al. ..... 62/282
4,457,139 A 7/1984 Ibrahim ..... 62/256
4,478,047 A 10/1984 Ibrahim ..... 62/82
4,489,995 A * 12/1984 Barr ..... 312/236
4,514,988 A 5/1985 Ibrahim ..... 62/82
RE31,909 E 6/1985 Ibrahim ..... 62/82
4,523,439 A 6/1985 Denisot ..... 62/251
4,535,603 A 8/1985 Willitts et al. ..... 62/196.4
4,565,070 A 1/1986 Raymond ..... 62/81
4,750,335 A 6/1988 Wallace et al. ..... 62/248
4,829,776 A * 5/1989 Casanova ..... 62/125
4,938,034 A 7/1990 Rosanio et al. ..... 62/256
4,949,554 A * 8/1990 Branz et al. ..... 62/248
4,977,754 A 12/1990 Upton et al. ..... 62/248
4,979,371 A 12/1990 Larson ..... 62/81
4,984,435 A * 1/1991 Seino et al. ..... 62/434
4,993,233 A 2/1991 Borton et al. ..... 62/155
RE33,620 E 6/1991 Persem ..... 62/215
5,046,320 A * 9/1991 Loose et al. ..... 62/77
5,048,303 A 9/1991 Campbell et al. ..... 62/256
5,277,486 A 1/1994 Bustos ..... 312/125
5,293,902 A * 3/1994 Lapierie ..... 137/614.04
5,315,837 A 5/1994 Lego ..... 62/89
5,323,621 A 6/1994 Subera et al. ..... 62/196.4
5,347,827 A 9/1994 Rudick et al. ..... 62/440
5,475,988 A 12/1995 McGovern ..... 62/256
5,502,979 A * 4/1996 Renard ..... 62/256
5,508,898 A 4/1996 McGovern ..... 362/92
5,596,878 A 1/1997 Hanson et al. ..... 62/160
5,598,886 A 2/1997 Craido-Mellado ..... 165/254
5,606,863 A 3/1997 Kicklighter et al. ..... 62/89
5,626,028 A 5/1997 Graat et al. ..... 62/252
5,649,432 A 7/1997 Cavalea, III ..... 62/457.1
5,675,983 A 10/1997 Ibrahim ..... 62/255
5,722,254 A 3/1998 Roth et al. ..... 62/457.9
5,727,393 A 3/1998 Mahmoudzadeh ..... 62/81
5,743,098 A 4/1998 Behr ..... 62/80
5,743,102 A 4/1998 Thomas et al. ..... 62/185
5,755,108 A 5/1998 Ibrahim et al. ..... 62/256
5,887,440 A 3/1999 Dube ..... 62/82
5,921,092 A 7/1999 Behr et al. ..... 62/81
5,924,297 A 7/1999 Wolff et al. ..... 62/152
D413,459 S 9/1999 Evdokimoff ..... D6/472
5,964,512 A 10/1999 Borgen ..... 312/116
6,089,033 A 7/2000 Dubé ..... 62/156
6,094,925 A 8/2000 Arshansky et al. ..... 62/81
6,155,075 A 12/2000 Hanson et al. ..... 62/512
6,170,270 B1 1/2001 Arshansky et al. ..... 62/81
RE37,054 E 2/2001 Sherwood ..... 62/246
6,185,951 B1 * 2/2001 Lane et al. ..... 62/246
6,196,007 B1 3/2001 Schlosser et al. ..... 62/73
6,202,425 B1 3/2001 Arshansky et al. ..... 62/119
6,205,795 B1 3/2001 Backman et al. ..... 62/79
6,272,876 B1 8/2001 Roberts et al. ..... 62/255
6,311,512 B1 11/2001 Fung et al. ..... 62/272
6,360,548 B1 3/2002 Navarro ..... 62/93
6,381,976 B1 5/2002 Kempiak et al. ..... 62/255
6,393,768 B1 5/2002 Roche et al. ..... 49/506
6,401,399 B1 6/2002 Roche et al. ..... 49/501
6,427,468 B1 8/2002 Topper et al. ..... 62/272
6,438,983 B1 8/2002 Zellner et al. ..... 62/246
6,449,967 B1 9/2002 Dubé ..... 62/156
6,460,372 B1 10/2002 Fung et al. ..... 62/515
6,467,279 B1 10/2002 Backman et al. ..... 62/79
6,467,282 B1 10/2002 French et al. ..... 62/140
6,467,294 B1 10/2002 Walker et al. ..... 62/255
6,502,412 B1 1/2003 Dubé ..... 62/175
6,519,962 B1 2/2003 Schuetter ..... 62/255
6,539,741 B1 4/2003 Navarro ..... 62/256
6,547,346 B1 4/2003 Topper et al. ..... 312/116
6,619,052 B1 9/2003 Nash, Jr. ..... 62/89
6,629,422 B1 10/2003 Wellman ..... 62/155
6,647,735 B1 11/2003 Street et al. ..... 62/132
6,672,086 B1 1/2004 Zangari et al. ..... 62/156
6,672,087 B1 1/2004 Taras et al. ..... 62/173
6,684,650 B1 2/2004 Weyna et al. ..... 62/151
6,705,093 B1 3/2004 Taras et al. ..... 62/90
6,722,149 B1 4/2004 Saroka et al. ..... 62/256
6,745,588 B1 6/2004 Kahler ..... 52/246
2001/0042383 A1 11/2001 Chiang et al. ..... 62/246
2002/0163436 A1 11/2002 Singh et al. ..... 340/584
2002/0184904 A1 12/2002 Wellman ..... 62/186
2003/0230095 A1 12/2003 Kahler ..... 62/155
2004/0003601 A1 1/2004 Dube ..... 62/81
2004/0067290 A1 4/2004 Swofford et al. ..... 426/335
2004/0069002 A1 4/2004 Chuang et al. ..... 62/256
2004/0088069 A1 5/2004 Singh ..... 700/108

* cited by examiner

SERVICE CASE

CROSS REFERENCE TO RELATED APPLICATION(S)

This application claims the benefit of U.S. Provisional Application Ser. No. 60/314,196, filed Aug. 22, 2001; and is a Division of application Ser. No. 10/223,760, filed Aug. 19, 2002, now abandoned.

BACKGROUND OF THE INVENTION

The present invention relates to a temperature controlled case for storage and display of chilled and/or frozen products, especially in a store environment.

A typical cooling coil in a refrigerated case is constructed of metal, such as copper or aluminum. Since this material is metal, it is quite noticeable when mounted in a refrigerated case. Case manufacturers try to conceal this coil by placing an attractive cover over the coil or placing the coil in a hidden location, as under the product shelf. However, although these methods hide the coil, they do not make the case particularly attractive and may affect refrigeration efficiency.

Refrigeration case shelving is generally made from painted metal or stainless steel. This type of shelving may be used to cover a forced air evaporator mounted beneath the shelf, or there may be a gravity feed coil mounted above the shelving. However, the main purpose of the shelving is to hold and display the product within the refrigerated case. Therefore, in both of the foregoing applications, the actual cooling of the product is achieved from the gravity feed coil mounted above the shelf or from the forced air coil mounted below the shelf, which is not entirely satisfactory.

Therefore, it is a principal object of the present invention to provide an improved, temperature controlled case for storage and display of cooled and/or frozen products.

It is a further object of the present invention to provide a case as aforesaid which is efficient and at the same time esthetically pleasing.

It is an additional object of the present invention to provide a case as aforesaid which may be readily and effectively used in a commercial store environment.

It is a further object of the present invention to provide a coolant service case with coolant means above and below product storage.

It is a still further object of the present invention to provide a coolant service case as aforesaid with coolant means above the product and coolant means beneath the product, including coolant gravity coils and gravity louvers above the product and refrigerated pans beneath the product.

Further objects and advantages of the present invention will appear hereinbelow.

SUMMARY OF THE INVENTION

In accordance with the present invention, the foregoing objects and advantages are readily obtained.

The present invention provides a temperature controlled case for storage and display of chilled and/or frozen products. The coolant service case of the present invention includes at least one cooling coil above the product and a cooling shelf beneath the product, including separate coolant supply and discharge lines from a coolant supply means to the cooling coil and shelf. The coolant coils above the product desirably includes coolant gravity coils and gravity louvers with drains and preferably lighting included therein.

In accordance with one embodiment, the coolant shelf beneath the product includes separate cooling sections for holding product. In accordance with a further embodiment, the shelf is divided into separate sections. In accordance with a still further embodiment, means are provided to warm the coolant for at least one of said cooling coil and shelf.

Further features and advantages of the present invention will appear hereinbelow.

BRIEF DESCRIPTION OF THE DRAWINGS

The present invention will be more readily understandable from a consideration of the following illustrative drawing, wherein.

DETAILED DESCRIPTION OF PREFERRED EMBODIMENTS

Figure 1:
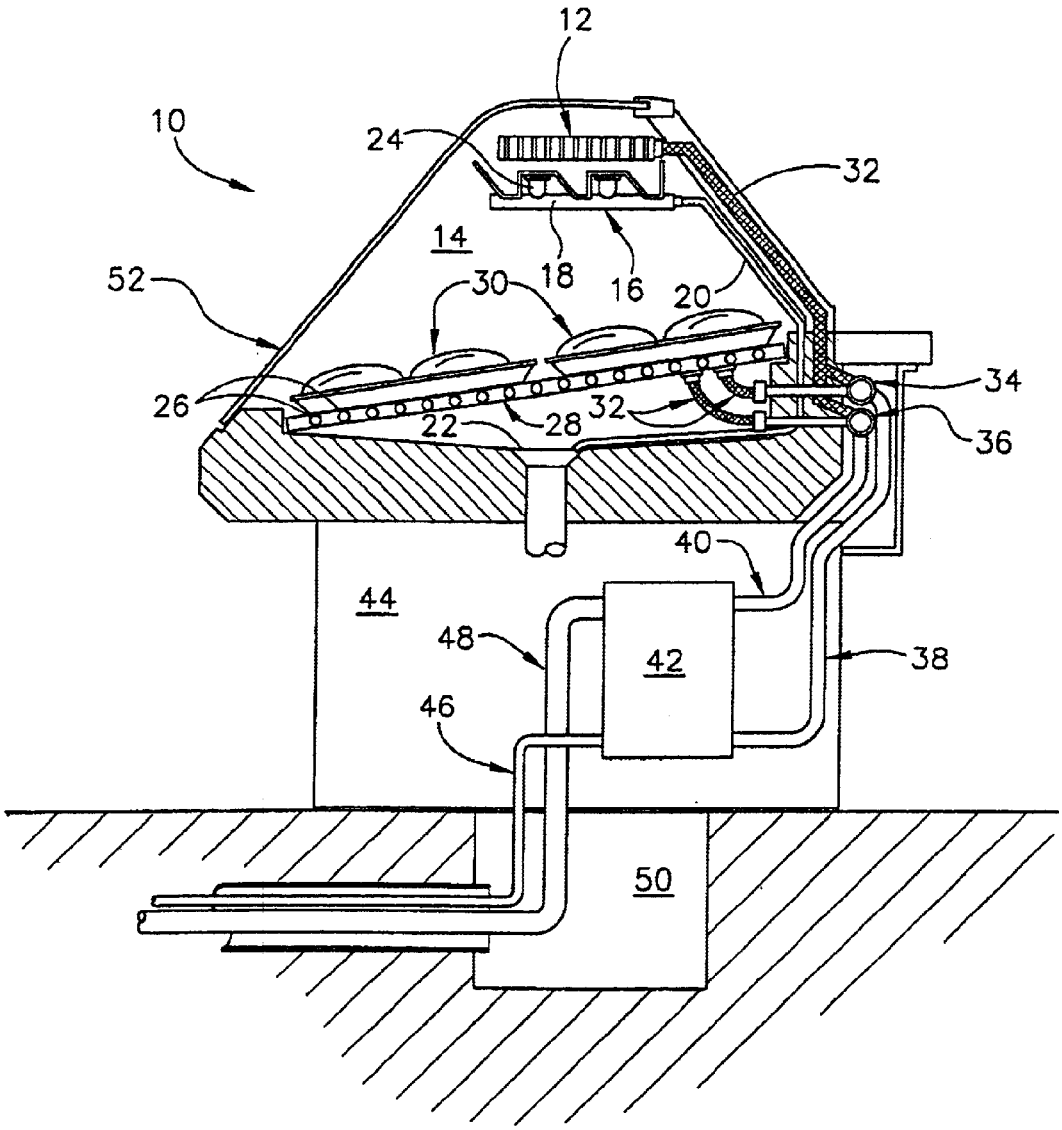
FIG. 1 is a cross-sectional view of a representative coolant service case of the present invention.

FIG. 1 shows a cross-section of a temperature controlled case (10) of the present invention. A secondary coolant gravity coil (12) is situated near the top of the refrigerated space (14). Mounted below the coil is a gravity louver assembly (16) which is designed to both direct air flow through the refrigerated space and catch water falling from the coil above from condensation or melting during defrost cycles. A drain pan (18) directs the flow of water from the louvers (16) into piping (20) connected to the main case drain (22). The louver assembly (16) may also contain an integrated lighting system (24) to better illuminate the product.

Secondary coolant is also circulated through channels (26) inside refrigerated pans or shelf (28) which provide additional cooling. The pans or shelf may be insulated on their underside to prevent heat transfer to the unused space below. Above the pans or shelf, the products (30) are placed in containers, desirably made of a metallic or otherwise heat-conductive material. The secondary coolant flows to and from the cooling coils (12) and to and from the refrigerated shelf or pans inside of flexible hoses (32) which may be equipped with valved quick-disconnect fittings to facilitate removal of the coils or shelf for cleaning or other maintenance.

Supply (34) and return (36) headers for the coolant are placed preferably in the back of the case for connection to the refrigerated coils and shelf. Chilled secondary coolant flows into the supply header (34) through the secondary coolant supply line (38) and coolant flows out of the return header (36) through a secondary coolant return line (40), both of which may either be connected to a packaged chiller (42) or a centralized chiller for multiple cases or the entire facility.

The packaged chiller (42) may consist of a pump to provide flow of coolant and a heat exchanger to provide heat flow from the secondary coolant to a primary coolant, preferably a volatile refrigerant. Additional equipment may also be included to facilitate temperature controls, safety devices, and to provide defrost of the coils and pans.

The chiller (42) is preferably contained within a pedestal base (44) to be hidden from view of the customer. In some situations where a direct expansion system already exists within a store, a refrigerant liquid line (46) and suction line (48) can provide flow of a primary refrigerant to the packaged chiller, possibly through a refrigeration pit (50) already existing in the floor.

In a conventional manner, the coolant service case of the present invention includes an openable door 52 for access to stored products.

In accordance with the present invention, a refrigerated case shelf is provided that is refrigerated by a means of pumping a chilled liquid through the shelf and the shelves are divided into smaller sections for removal and case cleaning. The case selves are supplied a chilled liquid by means of a chilled liquid header system. The header system includes a chilled liquid inlet header and a chilled liquid outlet header. The shelves are connected to the header system via liquid tight connectors that allow the refrigerated shelves to be disconnected from the chilled liquid headers, without losing substantial amounts of the chilled liquid.

Today's case designs use refrigerated coils to cool the case. These coils may be mounted above and below the product shelves. However, it has been found that one single refrigerated shelf or plate has many disadvantages. The plate is generally large and difficult to manufacture. The large plate cannot be readily removed for cleaning bacterial contamination from the case. If the plate is made to be removed, having one single, large plate filled with liquid is not a practical construction. The weight of a single 6–8 foot plate filled with liquid is generally too great for store personnel to remove. Moreover, a single plate design also means that there would be a need for multiple sizes based on the case size. For example, one would need a 4 foot plate for 4 foot cases and an 8 foot plate for 8 foot cases. Typical case sizes include, 4, 6, 8 and 12 foot sizes. The multi-section refrigerated shelf and header design of the present invention overcomes these disadvantages. The manufacturing cost of a multi-shelf header design is greater, but it provides the best means of removing the refrigerated shelves for cleaning, for example, to remove food borne pathogens and bacteria from the case.

Figure 2:
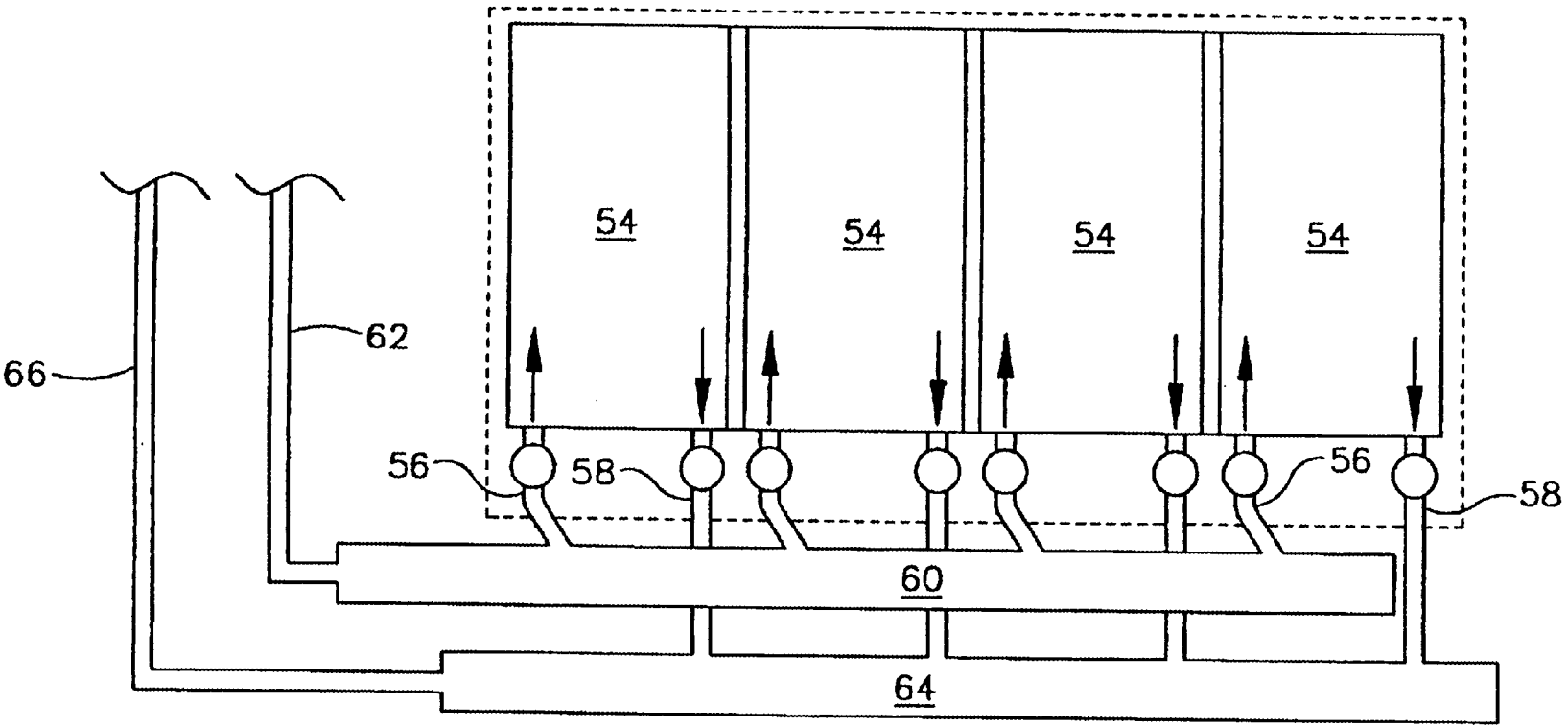
FIG. 2 is a partly schematic view of the inside bottom portion of a coolant service case of the present invention.

FIG. 2 shows the inside bottom of the case for the multi-plate design of the present invention with separate inlets and outlets. Multiple shelves (54) are shown with coolant liquid inlet lines (56) and coolant liquid outlet lines (58). Inlet lines (56) are connected to coolant liquid inlet header (60), which in turn is connected to chilled coolant supply lines (62), and coolant liquid outlet header is connected to coolant liquid outlet header (64), which in turn is connected to coolant outlet supply line (66). The supply lines are connected to a chilled liquid supply (not shown).

Figure 3:
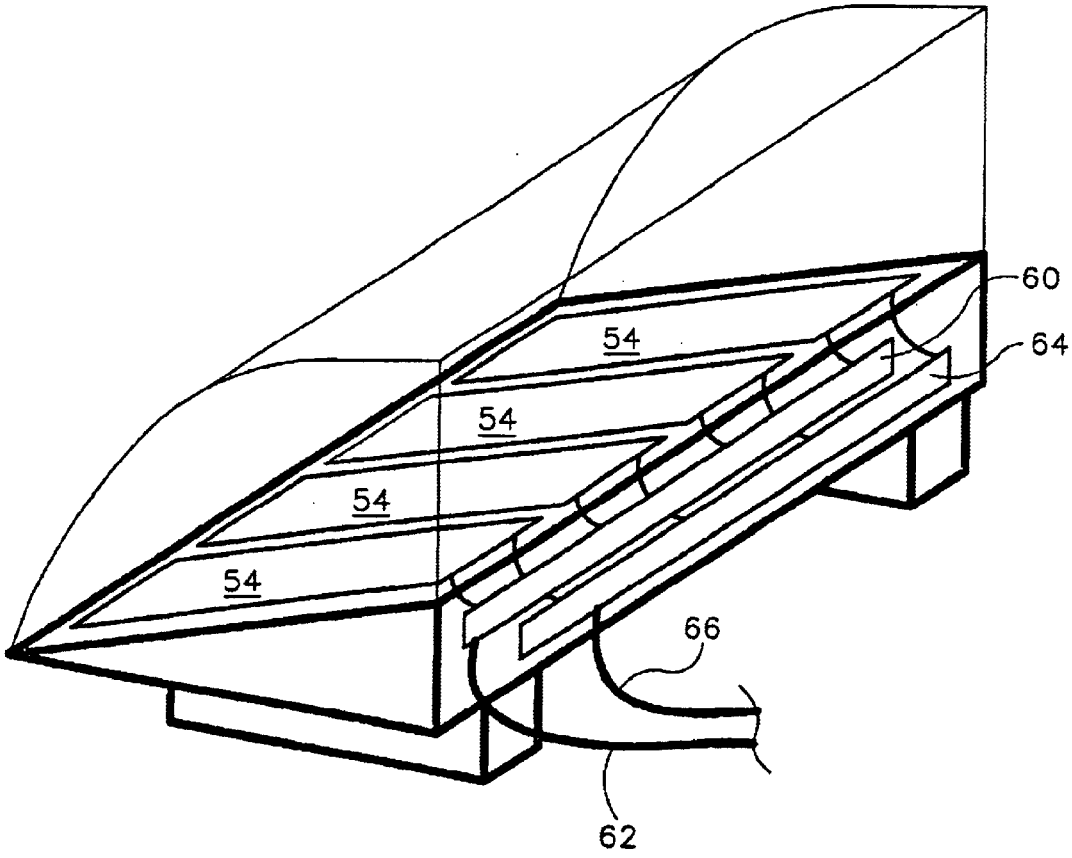
FIG. 3 is a perspective view of a coolant service case of the present invention without the upper coils.
Figure 4:
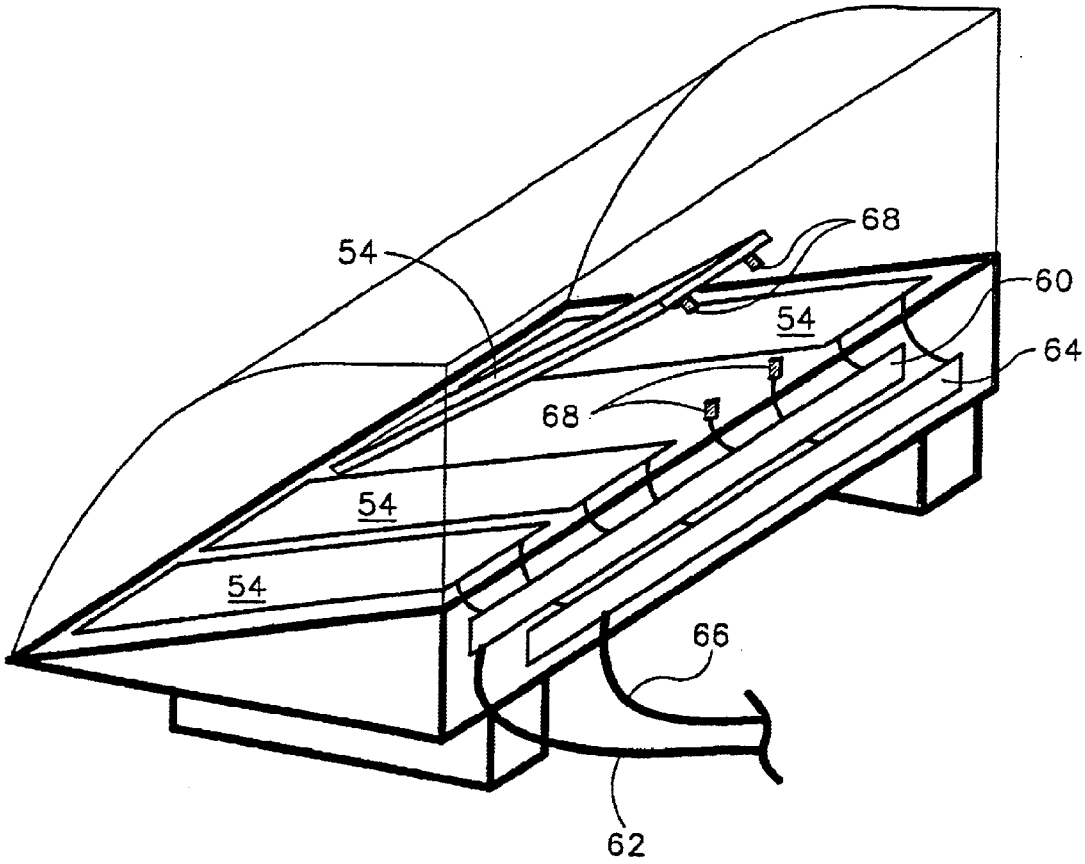
FIG. 4 is a view similar to FIG. 3 showing the removal of one of the sections of the refrigerated shelf.

FIGS. 3–4 show the multi-plate design installed and with the removal of one plate. For convenience, the upper plates are not shown.

FIG. 3 shows the refrigerated shelf with four (4) separate shelf sections, as in FIG. 2.

FIG. 4 shows one of the refrigerated shelf sections disconnected from the chilled liquid headers (60, 64) via the means of low liquid loss connectors (68). The connectors (68) provide an easy means for the store personal to remove the liquid filled shelves without spilling large amounts of the refrigerated liquid. In the above example, the refrigerated shelves are divided into separate sections, as four sections allowing much smaller and lighter sub-sections of shelving.

Figure 5:
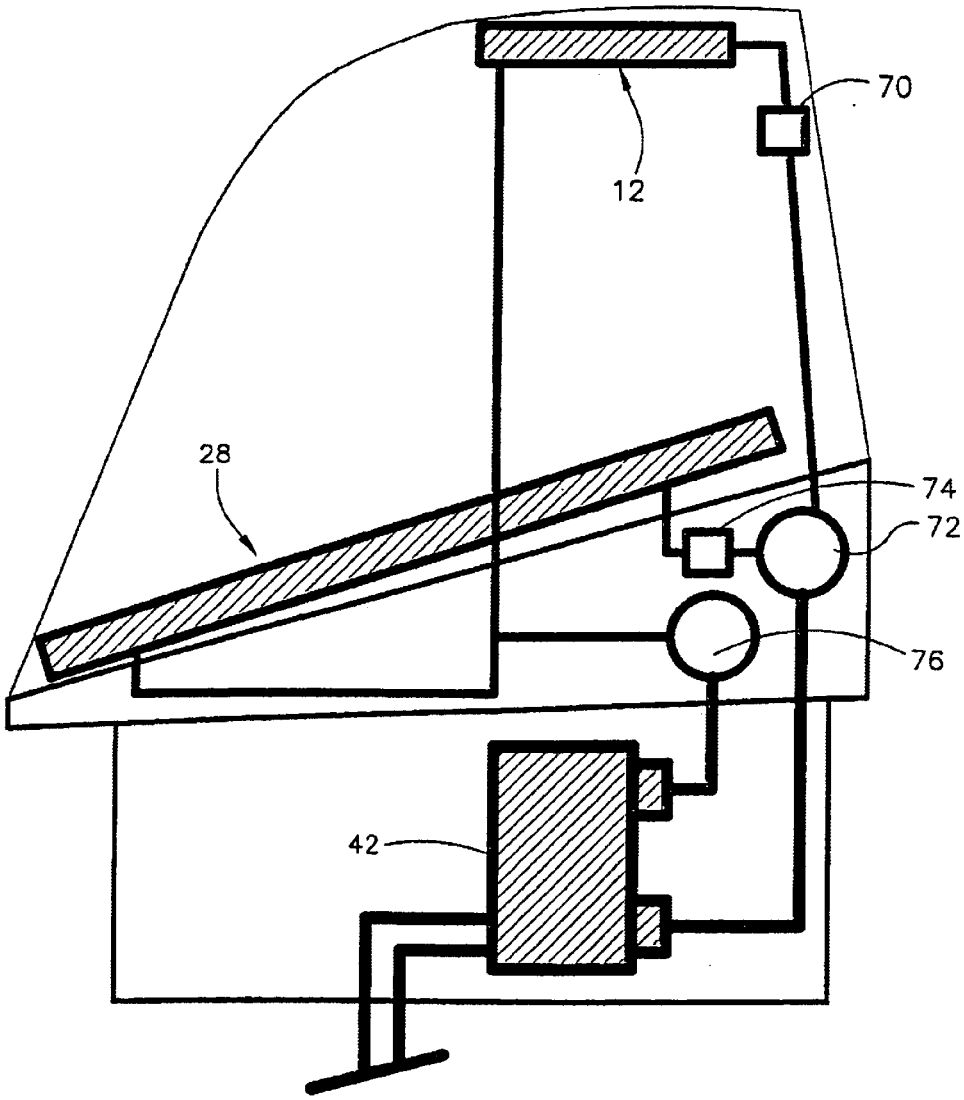
FIG. 5 is a sectional view showing various components of a refrigerated case of the present invention.

The present invention also provides a means of controlling the top coil temperature separately from the refrigerated shelf or pan temperature. This is shown in FIG. 5, which shows a view similar to that shown in FIG. 1. The control may be accomplished by restricting or stopping the flow of chilled liquid to and/or from the top coil (12) or the shelf or pans (28) via a liquid stop solenoid, flow regulator, flow valve, orifice, electronic valve or a change in line size or diameter. When the flow rate is slowed through the shelf or top coil, the temperature will rise, when the flow rate is increased, the temperature decreases. In addition, the present invention provides control of the top coil separately from the bottom coil to increase humidity in the case, and control of the top coil separately from the bottom coil for the purpose of defrosting the top coil or pan at different times and duration.

To control the top coil separately from the bottom shelves, the present invention desirably provides flow regulators (70) installed between the chilled liquid supply header (CLSH) (72) and the top coil (12), then another flow regulator (74) installed between the CLSH (72) and the bottom shelves (28). One of these could be piped directly to the CLSH with only one item having a flow regulator valve installed. This would allow one item, such as the shelves, to be controlled based on the CLSH temperature while the other item, the top coil, may be controlled separately. However, with the shelves being controlled by the CLSH, the CLSH will have to defrost along with the shelves, thus also causing the coil to enter a defrost stage. With separate flow regulating devices, the top coil and shelves can be defrosted separately and the CLSH would never need to defrost. FIG. 5 shows illustration of this system's piping, showing the upper coils (12), shelf (28), flow regulators (70, 74), chilled liquid supply header (72), return header (76) and chiller (42).

During normal operation, it very important that the product temperature be precisely controlled. The case will hold the most expensive product in the supermarket and the most volatile to food borne pathogens, which cause over 6,000 deaths per year in the US. The FDA has mandated that a 41 degree product temperature be maintained at all times to prevent food borne illnesses. Therefore, the dual temperature control of the present invention allows flexible temperature control during normal operation.

When the case is refrigerating, the shelf temperature will be set at the temperature desired for the product. For example, if the product was fresh beef, the shelf temperature would be set at 30 degrees. Because the fresh meat sits directly on the refrigerated shelves, the meat will be held at 30 degrees. Then the coil temperature will be set at 28 degrees to maintain the air temperature in the case. By setting the shelf temperature higher than the coil temperature, a very slow convection cooling effect will happen inside the case, causing very slow air movement over the product.

In addition to controlling the temperature, when cycling the top coil's flow regulator based on the coil's actual temperature, the amount of moisture being removed from the case can be precisely controlled. In a conventional case, the top coil is controlled to maintain product temperature. However, in the case design of the present invention, the product temperature is mostly controlled by controlling the shelf flow regulator. The top coil is now available to be cycled based on the case's air and the coils temperature, which directly affect the case's humidity.

This is a significant case feature, since the product in the case is fresh meat, seafood or any other fresh product that may need to maintain a high moisture level. In the case of fresh beef, the weight, look, and freshness of the beef are mostly determined by the liquid content of the beef. If the top coil has to operate at a very low temperature, as is the case on a conventional case, the coil builds a very high frost level. This frost comes directly from two sources, one being the operating environment, such as the building the case is installed in, and two being from the fresh meat itself. When the fresh meat loses moisture in the form of frost on the top coil, the product loses weight and start to get a very dry look. The weight directly affects the profits from the sales of the meat. The dry look affects the customer's desire to buy the product. Both of which are very negative.

By controlling the top coils temperature exactly, using the top coils flow regulator, design of the present invention will maintain a much higher humidity, keeping more of the moisture in the fresh meat as opposed to turning the moisture into frost on the top coil. Moreover, the reason the top coil can be maintained at a separate and desired temperature level, is that the bottom shelves are controlled to maintain the actual product temperature by cycling the shelf flow regulator.

In a traditional case, the case enters defrost and stops defrosting as one unit. All coils and refrigeration devices enter defrost at the same time. When this happens the case temperature and product temperature rises, until the defrost cycle has ended. Then the product temperature and case temperature is pulled down to the level of normal operation. This momentary rise in product temperature two, three or four times a day, can directly affect the product life, color and bacterial growth. If this product rise happens to often, it can cause a real food safety issue in the case.

With the design of the present invention, one can defrost the top coil while still refrigerating the bottom pans. Next the pans can be defrosted will the top coil is still refrigerating. By defrosting these separately in this fashion, the product is always being cooled by one device, while the frost level is being reduced on the other. Reducing the frost level is a must in all refrigerated applications, in order to maintain case performance and cooling capacity. Since the product is always receiving cooling effect from one device, the product temperature change during a defrost cycle, is very minimal.

In addition to cycling defrost at different times, the defrost times and duration can vary. In this case, the refrigerated shelves or pans are not as affected by frost as the top coil is. Therefore, the top coil can be defrosted more times a day than the bottom pans. By reducing the amount of total defrosts, the product temperature will be better maintained.

Figure 6:
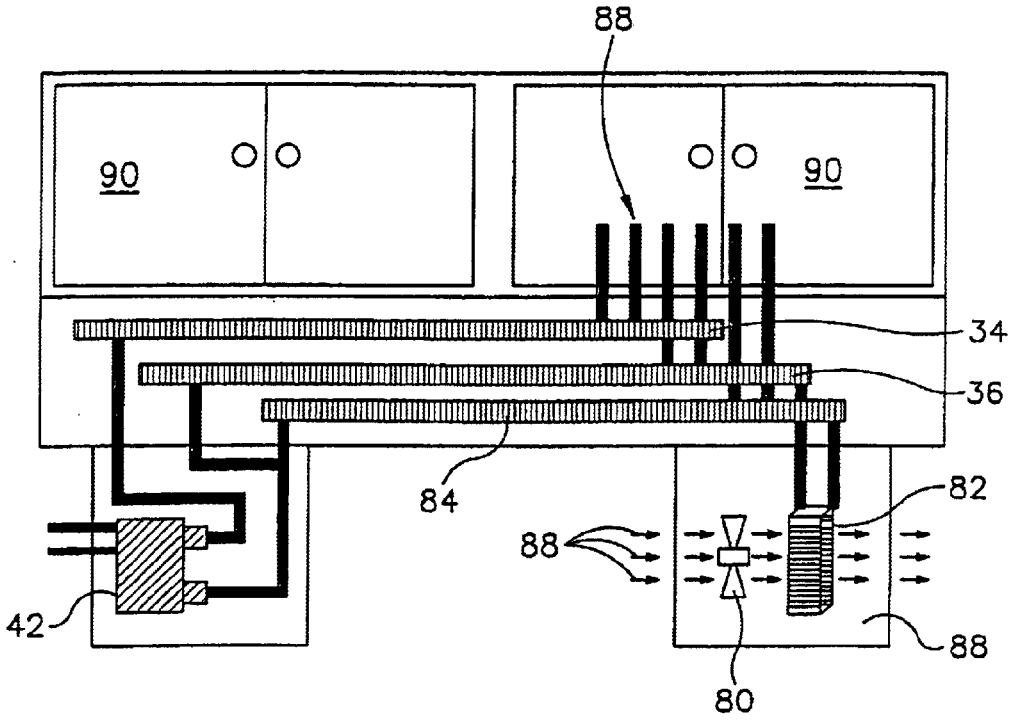
FIG. 6 is a rear view of a refrigerated case of the present invention.

In addition, the present invention provides for the installation of a heat exchanger in the case for the purpose of using store ambient air to generate warm fluid at the case to defrost or temperature control at least one of the top coil and refrigerated pans. This is illustrated in FIG. 6 which shows a rear view of a case of the present invention. In a conventional case, hot gas or an electric heater is used to generate heat in the case to defrost the case coils. These systems are direct expansion systems, using only a refrigerant gas. Since the design of the present invention uses a small secondary cooling loop that pumps a chilled liquid, such as glycol or water, that is much more environmentally friendly, one needs a way to defrost the coils, without a hot gas or electric heater. To generate a warm liquid, the present invention desirably installs a fan (80), coil (82) and a warm liquid defrost header (84).

The case operation for refrigeration will remain the same as previously mentioned, however, during a defrost cycle, the warm liquid will be pumped from the warm liquid defrost header (84) through the top coil or refrigerated pans. The warm liquid will quickly defrost the device, removing all frost from the device.

The use of a small air cooled coil (82), fan (80), header (84) and all associated valves needed to bypass the chilled liquid that is normally sent to the top coil and pans. The chilled liquid will be replaced with the warm fluid, thus causing a rapid thaw of the frost from the top coil and bottom pans.

The warm liquid for defrost could be generated in the above fashion or by using a storage vessel or a small holding tank (86) with heating means, as heating coils (82) or an electric heater. The most economic way to generate the warm liquid would be using the warm or ambient air (88) from the store environment. Also note, if the system does not have a plate heat exchanger at the case, generating warm liquid for defrost using this method would most likely not be used. The warm liquid generation and valves would be in the store's machine room where the plate heat exchanger would be installed.

Thus, referring to FIG. 6, which shows the rear of the present case, chiller (42) is connected to chilled liquid supply header (34) and return header (36) which in turn are connected to piping (88) for the coils and shelves (not shown in FIG. 6). Doors (90) are shown to provide access to the case. Warm liquid defrost header (84) is connected to heating coils (82) as described above.

Alternatively, the means to warm the secondary coolant can be accomplished by means of a ground loop system, where piping is installed in or below the foundation of the building to retrieve heat generated by the earth for the purpose of warming the secondary coolant. As a further alternative, one can warm the secondary coolant by using a solar collector that uses solar energy to heat the secondary coolant. As a still further alternative, one can warm the secondary coolant by using the discharge heat from the primary cooling system for the means of warming the secondary coolant. Still further, one can warm secondary coolant by using heat generated by electric heaters to heat air that is blown across a coil by use of a fan, where the secondary coolant travels through the coil.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A temperature controlled case for use in a store environment for storage and display of chilled or frozen products, which comprises:

at least one compartment for storage of products;

at least one access opening providing entrance to the compartment;

at least one shelf within the compartment for products;

at least one cooling coil above the shelf configure to cool the air within the compartment;

a refrigeration system configured to circulate a coolant to maintain a selected temperature within the compartment;

a defrost system comprising a heat exchanger configured to use air from the store environment to warm the coolant for circulation to the coil;

wherein coolant can be circulated from the refrigeration system to the coil to maintain a selected temperature in the compartment and coolant can be circulated from the defrost system to the coil to defrost the coil.

2. A temperature controlled case according to claim 1, wherein the refrigeration system further comprises a primary and secondary cooling system, wherein the primary cooling system chills coolant in the secondary cooling system to provide cooling.

3. A temperature controlled case according to claim 2, wherein the refrigeration system circulates coolant to the shelf.

4. A temperature controlled case according to claim 2, wherein the defrost system circulates coolant to the shelf.

5. A temperature controlled case according to claim 1, further comprising water-tight connectors and flexible tubing for connecting at least one of the shelf and the coil to a coolant supply header and a coolant discharge header.

6. A temperature controlled case according to claim 1, further comprising a temperature control system for restricting or stopping the flow of coolant through at least one of the coil and the shelf.

7. A temperature controlled case according to claim 5, further comprising a separate coolant supply line and coolant discharge line extending between the coolant supply header and the coolant discharge header and the coil and the shelf.

8. A temperature controlled case according to claim 1, further comprising at least one flow regulating device to regulate the flow of coolant through at least one of the coil and the shelf.

9. A temperature controlled case according to claim 8, wherein the heat exchanger includes a coil and a fan.

10. A system for storage and display of chilled or frozen products in a store comprising:

a case defining a compartment for storing the products;

a first cooling system having a first coolant and a second cooling system having a second coolant;

a cooling coil configured to receive the second coolant for cooling air within the compartment;

a shelf beneath the coil and configured to receive the second coolant; and a control system configured to control the flow of the second coolant to the coil and the shelf;

so that flow of second coolant to the coil and the shelf can be regulated by the control system to control a temperature of the coil separately from a temperature of the shelf and to maintain a selected temperature within the compartment.

11. The system of claim 10 wherein the shelf is provided in separate sections configured to be separately removable from the case.

12. The system of claim 11 further comprising quick disconnect fittings coupled to the separate sections.

13. The system of claim 10 wherein the control system comprises at least one flow regulator configured to control flow of second coolant.

14. The system of claim 13 further comprising a first coolant line configured to circulate second coolant to the coil and a second coolant line configured to circulate second coolant to the shelf.

15. The system of claim 14 wherein the flow regulator is configured to control flow of second coolant through the second coolant line.

16. The system of claim 14 further comprising a first flow regulator to control flow of second coolant to the coil and a second flow regulator to control flow of second coolant to the shelf.

17. The system of claim 16 wherein the first flow regulator and the second flow regulator comprise a solenoid valve.

18. The system of claim 13 wherein the flow regulator is operable to maintain the temperature of the shelf at a level greater than the temperature of the coil.

19. The system of claim 10 further comprising a louver device beneath the coil.

20. The system of claim 10 further comprising a defrost system configured to warm the second coolant with air from the store during defrosting of at least one of the coil and the shelf.

21. The system of claim 20 wherein the control system is operable to defrost the coil at a first frequency and to defrost the shelf at a second frequency, where the first frequency is greater than the second frequency.

22. The system of claim 20 wherein the defrost system comprises a fan and coil for warming the second coolant with air from the store.

* * * * *

UNITED STATES PATENT AND TRADEMARK OFFICE

CERTIFICATE OF CORRECTION

PATENT NO. : 6,883,343 B2
APPLICATION NO. : 10/465367
DATED : April 26, 2005
INVENTOR(S) : Mark Lane et al.

It is certified that error appears in the above-identified patent and that said Letters Patent is hereby corrected as shown below:

On the title page (75) add the following:
Yakov Arshansky, Conyers, GA (US);
David K. Hinde, Rex, GA (US);
Richard N. Walker, Monroe, GA (US)

Signed and Sealed this

Twenty-eighth Day of August, 2007

JON W. DUDAS
*Director of the United States Patent and Trademark Office*